US007508123B2

(12) United States Patent
Lee et al.

(10) Patent No.: US 7,508,123 B2
(45) Date of Patent: Mar. 24, 2009

(54) ELECTRON EMISSION DEVICE WITH BLACK LAYER AND METHOD OF PREPARING THE SAME

(75) Inventors: Soo-Joung Lee, Suwon-si (KR); Seung-Joon Yoo, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 616 days.

(21) Appl. No.: 10/997,774

(22) Filed: Nov. 23, 2004

(65) Prior Publication Data

US 2005/0122029 A1 Jun. 9, 2005

(30) Foreign Application Priority Data

Nov. 26, 2003 (KR) ..... 10-2003-0084502

(51) Int. Cl.
*H01J 1/62* (2006.01)
*H01J 63/04* (2006.01)

(52) U.S. Cl. ..... 313/496; 313/495; 313/497

(58) Field of Classification Search ..... 313/495–497, 313/309–311, 336, 346 R, 351
See application file for complete search history.

(56) References Cited

U.S. PATENT DOCUMENTS 5,477,105 A * 12/1995 Curtin et al. ..... 313/422
5,534,749 A 7/1996 Ohoshi et al.
5,566,011 A * 10/1996 Steigerwald ..... 349/110
6,002,205 A 12/1999 Mougin et al.
6,208,404 B1 * 3/2001 Tomoyori et al. ..... 349/187
2002/0043924 A1 * 4/2002 Kato et al. ..... 313/496
2005/0082964 A1 * 4/2005 Konishi ..... 313/497

* cited by examiner

*Primary Examiner*—Toan Ton
*Assistant Examiner*—Kevin Quarterman
(74) *Attorney, Agent, or Firm*—Christie, Parker & Hale, LLP

(57) ABSTRACT

An electron emission device includes a first substrate with an electron emission region, and a second substrate with a light emitting region. The light emitting region emits light in response to electrons emitted from the electron emission region to produce images. A phosphor layer is formed with a predetermined pattern. A black layer is formed with a predetermined pattern at a non-light-emitting region within the phosphor layer pattern on the second substrate. The black layer includes a first region of chromium oxide or an oxide of chromium and one or more metals selected from the group consisting of indium, tin, indium-tin, copper, antimony, titanium, manganese, cobalt, nickel, zinc, lead, chromium, and combinations thereof. The first region is formed on an anode. A second region of metallic chromium is formed on the first region, and a third region of chromium oxide is formed on the second region.

13 Claims, 1 Drawing Sheet

ELECTRON EMISSION DEVICE WITH BLACK LAYER AND METHOD OF PREPARING THE SAME

CROSS-REFERENCE TO RELATED APPLICATION

This application claims priority to and the benefit of Korean Patent Application No. 10-2003-0084502, filed on Nov. 26, 2003 in the Korean Intellectual Property Office, the entire contents of which are incorporated herein by reference.

FIELD OF THE INVENTION

The present invention relates to an electron emission device and a method of preparing the same, and more particularly to an electron emission device having superior cycle life and display quality and a method of preparing the same.

BACKGROUND OF THE INVENTION

In general, a conventional electron emission device includes a cathode that is capable of emitting electrons and an anode covered by phosphors that emit light when struck by the electrons. The anode and cathode are respectively aligned on substrates to allow the emitted light to form a picture.

According to a base structure of one type of such an electron emission device, a field emission display (FED), a cold cathode electron emission source is aligned on a cathode substrate with an anode on which is formed a phosphor layer pattern made up of a plurality of phosphor cells which are struck by an electron beam to provide a variety of colors.

A black layer that reduces reflection of external light and improves contrast of the device is formed between phosphor cells within the phosphor layer pattern. Methods to improve contrast include applying graphite within the phosphor layer pattern, adhering pigments on the surface of the phosphor layer pattern, or forming an insulating layer of non-conducting material within the phosphor layer pattern and then forming a conductive layer on it.

The first method of applying graphite between the phosphor layer has display quality and cycle life problems because impurities such as $H_2O$, $O_2$, CO, $N_2$, $CO_2$, etc. may be generated from the graphite. The second method of adhering pigments on the surface of the phosphor layer pattern has a problem of reduced luminance in devices driven at low voltages. The third method of forming an insulating layer of non-conducting material and forming a conductive layer on it, as disclosed in U.S. Pat. No. 5,534,749 and U.S. Pat. No. 6,002,205, may improve display quality and resolution. This improvement is due to the non-conductive insulating layer increasing contrast, and the conductive layer preventing display instability due to electron beam scattering which is caused by secondary electrons and charge buildup. However, this third method is very complicated because an insulating layer of non-conductive material is formed and etched, and then a conductive layer is formed thereon and then etched to obtain a pattern.

SUMMARY OF THE INVENTION

In order to improve the cycle life and display quality characteristics of an FED, one embodiment of the present invention provides an electron emission device including a first substrate with an electron emission region and a second substrate with a light emitting region. The light emitting region has phosphor layers formed on the second substrate with a predetermined pattern and emits light by the electrons emitted from the electron emission region. This embodiment also includes at least one black layer formed in the non-light-emitting region of the phosphor layers of the second substrate with a predetermined pattern. The black layer is formed on the anode and includes a first region of chromium oxide. Alternatively, the first region can include an oxide of chromium and one or more metals selected from the group consisting of indium, tin, indium-tin, copper, antimony, titanium, manganese, cobalt, nickel, zinc, lead, chromium, and combinations thereof. A second region of metallic chromium is formed on the first region, and a third region of chromium oxide is formed on the second region.

Embodiments of the present invention also provide an electron emission device including a first substrate with an electron emission region and a second substrate with a light emitting region. In the light emitting region is at least one anode formed on one side of the second substrate. A phosphor layer comprising red, green, and blue cells is formed on the anode in a predetermined pattern and emits light by the electrons emitted from the electron emission region. An anode is formed on one side of the phosphor layer. A black layer is formed between the red green and blue cells of the phosphor layer, and includes a first region of chromium oxide. Alternatively, the first region is an oxide of chromium combined with at least one metal selected from the group consisting of indium, tin, indium-tin, copper, antimony, titanium, manganese, cobalt, nickel, zinc, lead, chromium, and combinations thereof. A second region of metallic chromium is formed on the first region, and a third region of chromium oxide is formed on the second region.

One embodiment of the present invention also provides a method of preparing an electron emission device. A first substrate includes an electron emission region and a second substrate includes a vacuum container and has a light emitting region. The embodiment further includes forming a metallic chromium layer with a predetermined pattern on one side of the second substrate by depositing chromium on an anode. The anode is made of oxide which includes one or more metals selected from the group consisting of indium, tin, indium-tin, copper, antimony, titanium, manganese, cobalt, nickel, zinc, lead, chromium, and combinations thereof. The method also includes forming a black layer including a first region of chromium oxide. Alternatively, the first region is made of an oxide of chromium combined with one or more metals selected from the group consisting of indium, tin, indium-tin, copper, antimony, titanium, manganese, cobalt, nickel, zinc, lead, chromium, and combinations thereof. A second region of metallic chromium is formed on the first region, and a third region of chromium oxide is formed on the second region by firing the substrate on which the metallic chromium layer pattern has been formed. The method also includes forming a phosphor layer within the spaces in the pattern of the black layer and firing the second substrate.

DETAILED DESCRIPTION OF THE PREFERRED EMBODIMENTS

Embodiments of the present invention will now be described in detail with reference to the accompanying drawings.

The present invention is related to improving quality and resolution of an electron emission device. In order to achieve this, according to one embodiment of the present invention, a black layer is formed on an anode, and the black layer includes a first region of: 1) chromium oxide; or 2) an oxide of chromium including one or more metals selected from the group consisting of indium, tin, indium-tin, copper, antimony, titanium, manganese, cobalt, nickel, zinc, lead, chromium, and combinations thereof. A second region of metallic chromium is formed on the first region, and a third region of chromium oxide is formed on the second region. In one embodiment, the black layer is a black matrix layer.

Figure 1:
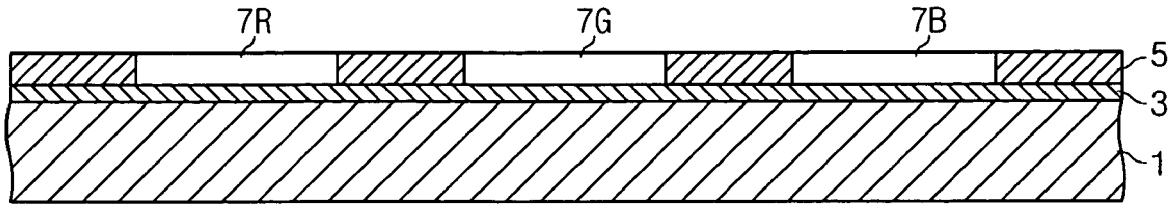
FIG. 1 is a cross-sectional view of the substrate of the present invention, on which a black layer and a phosphor layer pattern are formed.
Figure 2:
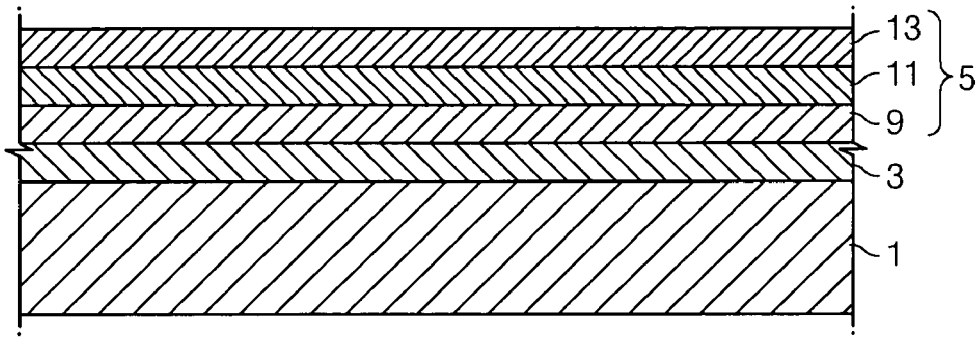
FIG. 2 is a partial cross-sectional view of the black layer.

FIG. 1 is a cross-sectional view of a substrate 1, on which a black layer 5 is formed. FIG. 2 is a partial cross-sectional view of the substrate 1 comprising the black layer 5. In one embodiment, an anode electrode layer 3 is between the substrate 1 and the black layer 5. As seen in FIG. 1, red, green, and blue phosphor cells 7R, 7G, 7B are formed in a pattern within spaces in the pattern of the black layer 5. Thus, the black layer 5, is formed "within" or "between" the phosphor layer, and the phosphor layer is formed"within" or "between" the black layer 5. As seen in FIG. 2, the black layer 5 includes a first region 9 of chromium oxide or an oxide of chromium including one or more metals selected from the group consisting of indium, tin, tin-indium, copper, antimony, titanium, manganese, cobalt, nickel, zinc, lead, chromium, and combinations thereof. A second region 11 of metallic chromium is formed on the first region 9, and a third region 13 of chromium oxide is formed on the second region. The first region may further comprise iron, molybdenum, or tungsten.

The first region 9 is a non-conductive film that improves contrast of the phosphor layer. The metallic chromium layer 11 prevents display instability due to electron beam scattering caused by secondary electrons and charge buildup, thereby improving display quality and resolution. The chromium oxide layer 13 reduces a specular reflectance, thereby further improving contrast.

In an exemplary embodiment of the present invention, the black layer has a thickness of at least 2500 Å. In further exemplary embodiments, the black layer has a thickness ranging from 3000 to 5000 Å or 3000 to 4000 Å. If the thickness of the black layer is below 2500 Å, blocking of light is insufficient, so that it is difficult to improve contrast.

Considering contrast and resolution of the electron emission device, the first region of the black layer has a thickness ranging from 100 to 3000 Å in one exemplary embodiment. If the thickness of the first region of the black layer is below 100 Å, blocking of light is insufficient, thereby impeding contrast improvement, as discussed above. Otherwise, if the thickness of the first region exceeds 3000 Å, the contrast does not increase. The second region of the black layer preferably has a thickness of at most 4000 Å. In exemplary embodiments, the thickness of the second region ranges from 200 to 3000 Å, or from 200 to 1000 Å. If the thickness of the second region exceeds 4000 Å, the contrast and the conductivity do not increase. Exemplary embodiments of the third region of the black layer have a thickness of at most 4000 Å, ranging from 500 to 3,000 Å, or ranging from 500 to 1000 Å. If the thickness of the third region exceeds 4000 Å, the specular reflectance is no longer improved.

In embodiments of the first region, the one or more metals selected from the group consisting of indium, tin, indium-tin, copper, antimony, titanium, manganese, cobalt, nickel, zinc, lead, chromium, and combinations thereof is comprised of at least 1 ppb, or from 1 to 1000 ppb. The chromium oxide making up the first region is $Cr_xO_y$ (where $0<x<10$, $0<y<25$) or $Cr_xM_yO_z$ (where M is a metal or combination of metals selected from the group consisting of indium, tin, indium-tin, copper, antimony, titanium, manganese, cobalt, nickel, zinc, lead, and chromium, and where $0<x<10$, $0<y<20$, and $0<z<25$). The second region is a metallic chromium layer and the third region is a $Cr_xO_y$ (where $0<x<10$ and $0<y<25$) layer.

The black layer may have a specular reflectance at 550 nm ranging from 0.01% to 60.5%, or from 0.01% to 30%. If the specular reflectance is higher than 60.5%, external light is reflected by the display, thereby reducing contrast. In exemplary embodiments, the chromium surface resistance ranges from 1 $\Omega/cm^2$ to 4 $\Omega/cm^2$, or from 1.1 $\Omega/cm^2$ to 2.5 $\Omega/cm^2$.

Accelerated electrons may accumulate on the surface of the non-conductive phosphor and cause reduction of light emission. If the black layer has a low surface resistance, the accumulated electrons may slip out through the black layer.

A more detailed description will be given about the process shown in FIG. 3. The first region, second region, and third region included in the black layer may be formed by deposition, or simply by firing without deposition. Chromium is deposited on an anode comprising an oxide of one or more metals selected from the group consisting of indium, tin, indium-tin, copper, antimony, titanium, manganese, cobalt, nickel, zinc, lead, chromium, and combinations thereof. The deposition occurs on one side of a substrate (S1), thereby forming a metallic chromium layer with a predetermined pattern (S2).

The coated substrate on which the metallic chromium layer pattern has been formed is fired under an air atmosphere (S3) to oxidize the chromium contacting the anode surface, thereby forming the first region. In other words, chromium is deposited on the anode that is made up of an oxide of one or more metals selected from the group consisting of indium, tin, indium-tin, copper, antimony, titanium, manganese, cobalt, nickel, zinc, lead, chromium, and combinations thereof. Then, when the coated substrate is fired, oxygen present in the anode is spread into the metallic chromium layer to: 1) form the blackened first region of oxide at the region contacting the anode; 2) form the third region of chromium oxide at the region contacting air, and 3) form the second region of metallic chromium at the region between the two. Because this method does not involve separate deposition of the non-conductive first region of a metal oxide, a conductive second region of metallic chromium, and a non-conductive third region of chromium oxide, mass production of the device becomes easy.

In an exemplary embodiment, the anode used to form the first region of the black layer is made of an oxide of one or more metals selected from the group consisting of indium, tin, indium-tin, copper, antimony, titanium, manganese, cobalt, nickel, zinc, lead, chromium, and combinations thereof. The metal oxide may further comprise iron, molybdenum, or tungsten. Specific examples of the metal oxide used as the anode are indium tin oxide (ITO), $SnO_2$, antimony tin oxide (ATO), and so on.

The anode can have a thickness of at least 100 Å, or a thickness ranging from 1000 to 3000 Å, so that the oxygen or metal present in the anode may spread into the metallic chromium layer.

Chromium deposition on the anode may be performed by sputtering, electron beam evaporation, vacuum thermal evaporation, laser ablation, chemical vapor deposition, thermal evaporation, plasma chemical vapor deposition, laser chemical vapor deposition, jet vapor deposition, and so forth, but it is not limited to these methods.

Patterning of the metallic chromium layer may be performed by photolithography or using a mask. A detailed description of the patterning method will be omitted, because it is well known.

In exemplary embodiments, firing of the substrate on which the metallic chromium layer pattern has been formed to form the black layer comprising the first, second, and third regions is performed at a temperature ranging from 350 to 600° C., or from 450 to 550° C. If the firing temperature is below 350° C., oxygen and the one or more metals may not sufficiently spread into the metallic chromium layer. Otherwise, if it exceeds 600° C., the metallic chromium layer may be damaged. In one embodiment, the firing is performed for at least one minute. In another embodiment, the firing is performed for 10 to 60 minutes. If the firing time is shorter than one minute, the first region may not be formed sufficiently.

Because formation of the first region of metal oxide proceeds by the spread of oxygen and metal present in the anode due to firing, it is not necessary to feed oxygen into the system from outside. Therefore, the firing atmosphere is not particularly limited.

Figure 3:
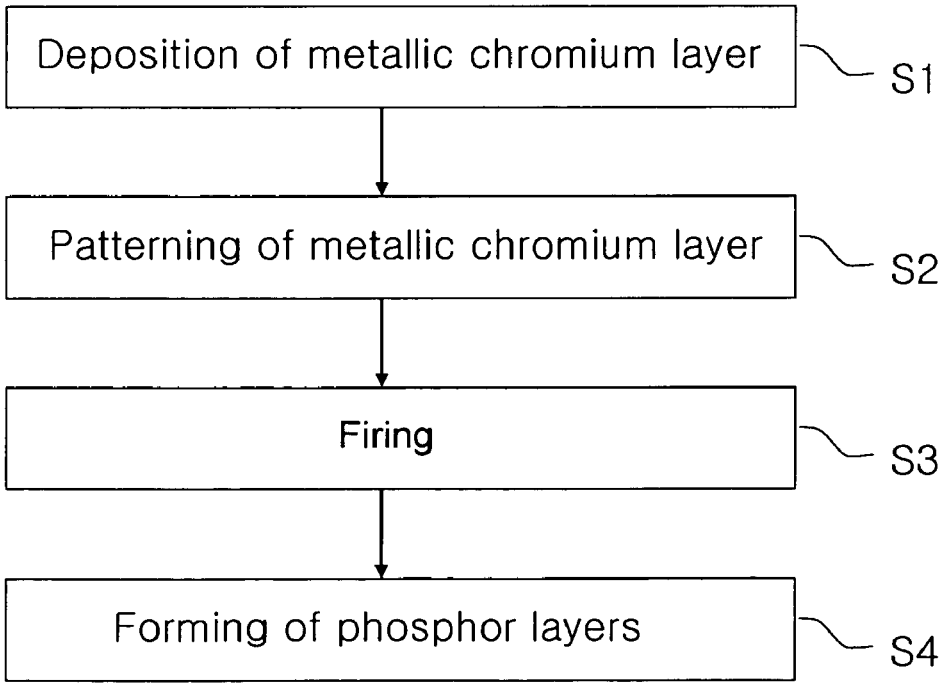
FIG. 3 is a block diagram of preparing the substrate of the present invention, on which a black layer and a phosphor layer pattern are formed.

After phosphors are formed between the resultant black layer, the phosphors and resultant black layer are fired to form a resulting substrate (S4 of FIG. 3).

In another exemplary embodiment of the present invention, a light emitting region may be formed by applying a transparent conductive film, e.g. an ITO film, on the second substrate, that is without forming an anode.

Hereinafter, the present invention will be described in more detail through examples. However, the following examples are only for the understanding of the present invention and the present invention is not limited by them.

EXAMPLES

Example 1

An ITO anode was formed to a thickness of 3000 Å on each of two clean glass substrates. Next, chromium was deposited to a thickness of either 2500 Å or 3500 Å to form a thin chromium layer on each of the anodes. Then, a chromium layer pattern was formed in each thin chromium layer by photolithography and fired under air atmosphere at the firing condition given in Table 1, below, to form a black layer comprising three layers, as shown in FIG. 2. After phosphor layers had been formed between the black layer, the coated substrate was again fired to obtain a resulting substrate.

Specular reflectance (%) of the resultant substrate at 550 nm and surface resistance of the metallic chromium layer were measured. The result is also given in Table 1. The specular reflectance was measured at a reflection angle of 30° with an incident angle of 30° using a tungsten halogen lamp having a color temperature of 3200 K. The surface resistance was measured by the 4-probe method.

TABLE 1

| Thickness of chromium layer (Å) | Firing temperature (° C.) | Firing time (min) | Specular Reflectance (550 nm, %) | Surface resistance ($\Omega/cm^2$) |
|---|---|---|---|---|
| 2,500 | 250 | 10 | 61 | 2.95 |
| | | 30 | 55 | 2.88 |
| | 400 | 10 | 40.7 | 2.87 |
| | | 30 | 26.6 | 2.85 |
| | 450 | 10 | 8.81 | 2.91 |
| | | 30 | 0.52 | 2.25 |
| | 650 | 45 | 25.1 | 3.01 |
| | | 75 | 27.2 | 3.25 |
| 3,500 | 250 | 10 | 60.2 | 2.88 |
| | | 30 | 59.1 | 2.86 |
| | 400 | 10 | 39.0 | 2.11 |
| | | 30 | 26.2 | 2.25 |
| | 450 | 10 | 6.09 | 2.33 |
| | | 30 | 0.18 | 2.10 |
| | 650 | 45 | 25.4 | 3.06 |
| | | 75 | 26.1 | 3.52 |

As shown in Table 1, because the substrate of the present invention has low specular reflectance and low surface resistance, it offers superior contrast and light emitting characteristics.

Example 2

In Example 2, the procedure of Example 1 was carried out without forming an anode.

The electron emission device includes a black layer having a first region of chromium oxide or an oxide of chromium oxide and one or more metals selected from the group consisting of indium, tin, indium-tin, copper, antimony, titanium, manganese, cobalt, nickel, zinc, lead, chromium, and combinations thereof. A second region of metallic chromium was formed on the first region, and a third region of chromium oxide was formed on the second region. Because of this constitution, contrast of the phosphor layer is improved and display instability due to secondary electrons and electron beam scattering caused by charge buildup is prevented. This improves display quality and resolution. Because the device does not include graphite, generation of such impurities as $H_2O$, $O_2$, CO, $N_2$, $CO_2$, and so forth, is prevented, so that the cycle life and quality of the display may be improved.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. An electron emission device comprising:

a first substrate comprising an electron emission region;

a second substrate comprising a light emitting region;

a phosphor layer formed on the light emitting region of the second substrate with a pattern; and a black layer formed at a non-light-emitting region between the pattern of the phosphor layer, the black layer comprising:

a first region of chromium oxide or an oxide of chromium and one or more metals selected from the group consisting of indium, tin, indium-tin, copper, antimony, titanium, manganese, cobalt, nickel, zinc, lead, and combinations thereof, the first region formed on an anode;

a second region of metallic chromium formed on the first region; and a third region of chromium oxide formed on the second region, wherein the black layer has a thickness of at least 2500 Å.

2. The electron emission device of claim 1, wherein the black layer has a thickness ranging from 3000 to 5000 Å.

3. The electron emission device of claim 2, wherein the black layer has a thickness ranging from 3000 to 4000 Å.

4. The electron emission device of claim 1, wherein the first region of the black layer has a thickness ranging from 100 to 3000 Å.

5. The electron emission device of claim 1, wherein the black layer has a specular reflectance at 550 nm ranging from 0.01% to 60.5% and a chromium surface resistance ranging from $1\Omega/cm^2$ to $4\Omega/cm^2$.

6. An electron emission device comprising:

a first substrate comprising an electron emission region;

a second substrate comprising a light emitting region;

a phosphor layer formed on the light emitting region of the second substrate with a pattern; and a black layer formed at a non-light-emitting region between the pattern of the phosphor layer, the black layer comprising:

a first region of chromium oxide or an oxide of chromium and one or more metals selected from the group consisting of indium, tin, indium-tin, copper, antimony, titanium, manganese, cobalt, nickel, zinc, lead, and combinations thereof, the first region formed on an anode;

a second region of metallic chromium formed on the first region; and a third region of chromium oxide formed on the second region, wherein the first region of the black layer further comprises iron, molybdenum, or tungsten.

7. An electron emission device comprising:

a first substrate comprising an electron emission region;

a second substrate, an anode formed on the second substrate, a phosphor layer formed on the anode with a pattern; and a black layer formed with a pattern between the pattern of the phosphor layer, the black layer comprising:

a first region of chromium oxide or an oxide of chromium and one or more metals selected from the group consisting of indium, tin, indium-tin, copper, antimony, titanium, manganese, cobalt, nickel, zinc, lead, and combinations thereof, the first region formed on the anode;

a second region of metallic chromium formed on the first region; and a third region of chromium oxide formed on the second region, wherein the black layer has a thickness of at least 2500 Å.

8. The electron emission device of claim 7, wherein the black layer has a thickness ranging from 3000 to 5000 Å.

9. The electron emission device of claim 8, wherein the black layer has a thickness ranging from 3000 to 4000 Å.

10. The electron emission device of claim 7, wherein the first region of the black layer has a thickness ranging from 100 to 3000 Å.

11. The electron emission device of claim 7, wherein the black layer has a specular reflectance at 550 nm ranging from 0.01% to 60.5% and a chromium surface resistance ranging from $1\Omega/cm^2$ to $4\Omega/cm^2$.

12. An electron emission device comprising:

a first substrate comprising an electron emission region;

a second substrate, an anode formed on the second substrate, a phosphor layer formed on the anode with a pattern; and a black layer formed with a pattern between the pattern of the phosphor layer, the black layer comprising:

a first region of chromium oxide or an oxide of chromium and one or more metals selected from the group consisting of indium, tin, indium-tin, copper, antimony, titanium, manganese, cobalt, nickel, zinc, lead, and combinations thereof, the first region formed on the anode;

a second region of metallic chromium formed on the first region; and a third region of chromium oxide formed on the second region, wherein the first region of the black layer further comprises iron, molybdenum, or tungsten.

13. The electron emission device of claim 7, wherein the anode comprises indium tin oxide.

* * * * *